US012553117B2

(12) United States Patent
Monerie-Moulin et al.

(10) Patent No.: US 12,553,117 B2
(45) Date of Patent: Feb. 17, 2026

(54) METHOD FOR MANUFACTURING A PART COMPRISING A METAL SUBSTRATE COVERED WITH A PROTECTIVE LAYER AND A PART MANUFACTURED ACCORDING TO THIS METHOD

(71) Applicant: SAFRAN LANDING SYSTEMS, Velizy-Villacoublay (FR)

(72) Inventors: Francis Monerie-Moulin, Moissy Cramayel (FR); Mathilde Arnoux, Moissy Cramayel (FR)

(73) Assignee: SAFRAN LANDING SYSTEMS, Velizy-Villacoublay (FR)

( * ) Notice: Subject to any disclaimer, the term of this patent is extended or adjusted under 35 U.S.C. 154(b) by 176 days.

(21) Appl. No.: 18/556,916

(22) PCT Filed: Apr. 20, 2022

(86) PCT No.: PCT/FR2022/050740
§ 371 (c)(1),
(2) Date: Oct. 24, 2023

(87) PCT Pub. No.: WO2022/229539
PCT Pub. Date: Nov. 3, 2022

(65) Prior Publication Data

US 2024/0218494 A1 Jul. 4, 2024

(30) Foreign Application Priority Data

Apr. 26, 2021 (FR) ..... 2104281

(51) Int. Cl.
*C23C 4/18* (2006.01)
*C23C 4/02* (2006.01)
(Continued)

(52) U.S. Cl.
CPC ..... *C23C 4/18* (2013.01); *C23C 4/02* (2013.01); *C23C 4/10* (2013.01); *C23C 4/129* (2016.01)

(58) Field of Classification Search
CPC .... C23C 4/18; C23C 4/02; C23C 4/10; C23C 4/129
(Continued)

(56) References Cited

U.S. PATENT DOCUMENTS 5,268,045 A * 12/1993 Clare ..... C25D 5/50 205/705
2006/0105113 A1 5/2006 Endicott et al.
2007/0261767 A1* 11/2007 Jarosinski ..... C23C 4/18 106/287.35

FOREIGN PATENT DOCUMENTS

EP 2 956 564 B1 8/2019
FR 3 002 239 A1 8/2014
(Continued)

OTHER PUBLICATIONS

International Search Report as issued in International Patent Application No. PCT/FR2022/050740, dated Jun. 3, 2022.

*Primary Examiner* — Tahseen Khan
(74) *Attorney, Agent, or Firm* — Pillsbury Winthrop Shaw Pittman LLP

(57) ABSTRACT

A method for manufacturing a part includes a metal substrate at least partially covered with a protective layer, includes preparing a surface of the substrate to be covered, forming by spraying, according to an HVOF spraying method, a coating layer on the prepared surface, this coating layer being formed by spraying a powder mixture containing submicronic metal carbide grains, impregnating the coating layer with an organic impregnant together forming an impregnated layer, finishing by polishing at least one surface of the impregnated layer in order to form a protective layer
(Continued)

having a polished surface having a roughness Ra of less than 0.2 μm or of less than 0.1 μm depending on the applications.

10 Claims, 4 Drawing Sheets

(51) Int. Cl.
*C23C 4/10* (2016.01)
*C23C 4/129* (2016.01)

(58) Field of Classification Search
USPC ..... 428/141
See application file for complete search history.

(56) References Cited

FOREIGN PATENT DOCUMENTS

| | | | |
|---|---|---|---|
| FR | 3 089 235 | A1 | 6/2020 |
| WO | WO 2004/000470 | A1 | 12/2003 |
| WO | WO 2014/125045 | A1 | 8/2014 |

* cited by examiner

[Fig. 1a]
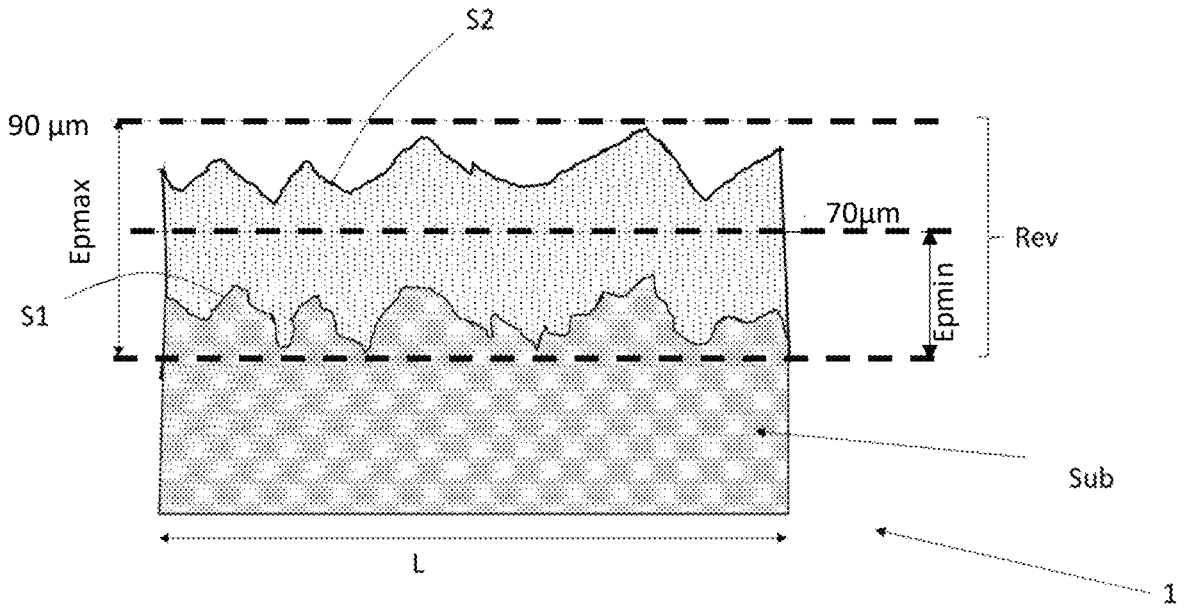
[Fig. 1b]
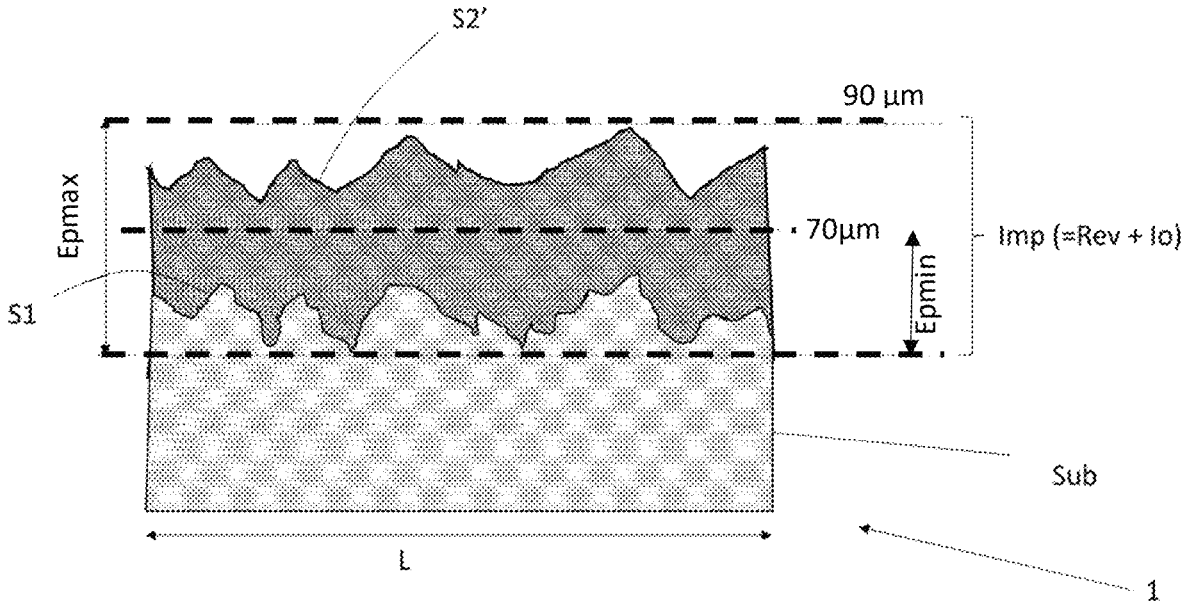

[Fig. 1c]
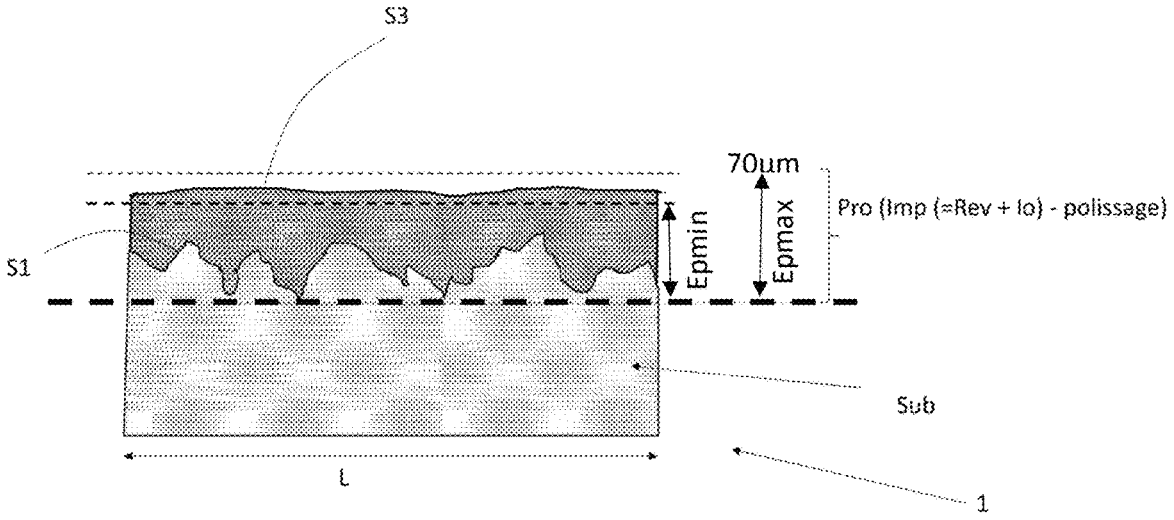

[Fig. 2]
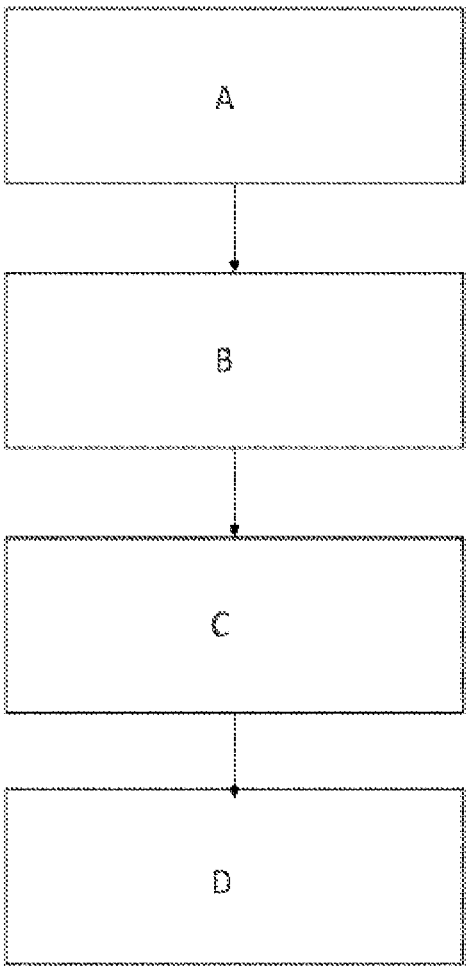

[Fig.3]
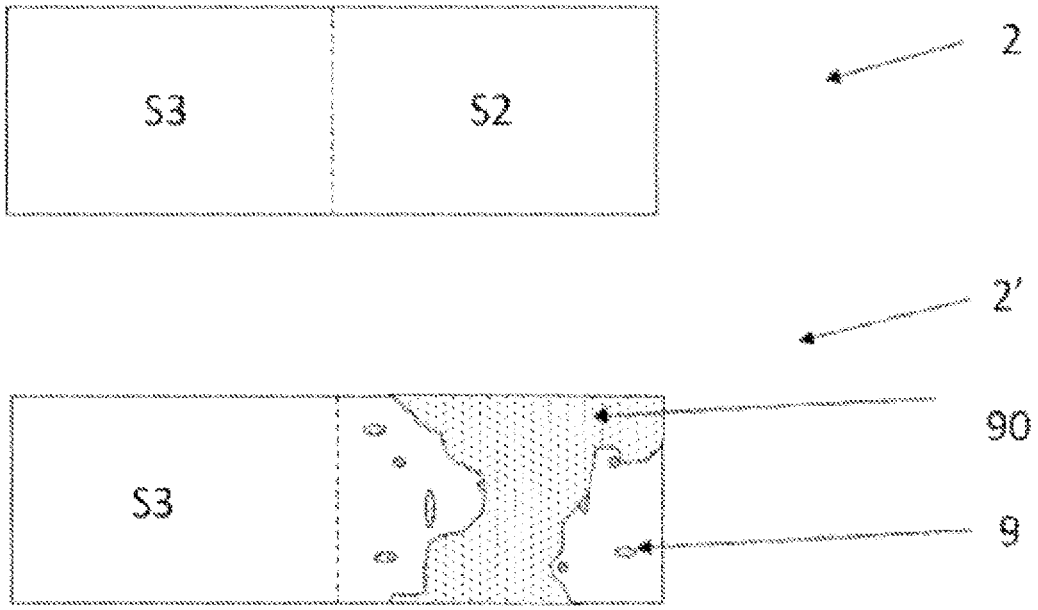

METHOD FOR MANUFACTURING A PART COMPRISING A METAL SUBSTRATE COVERED WITH A PROTECTIVE LAYER AND A PART MANUFACTURED ACCORDING TO THIS METHOD

CROSS-REFERENCE TO RELATED APPLICATIONS

This application is the U.S. National Stage of PCT/FR2022/050740, filed Apr. 20, 2022, which in turn claims priority to French patent application number 2104281 filed Apr. 26, 2021. The content of these applications are incorporated herein by reference in their entireties.

TECHNICAL FIELD OF THE INVENTION

The technical field of the invention is that of a method for manufacturing pieces, such as aeronautical pieces, including a substrate at least partially coated with a protective layer protecting the substrate.

The present invention relates to a method for manufacturing a piece including a metal substrate at least partially covered with a protective layer and a piece manufactured according to this method.

TECHNOLOGICAL BACKGROUND TO THE INVENTION

For example, methods for manufacturing pieces are known which include applying, to a metal substrate, via a metal bath, a hard chromium coating layer serving both to protect the substrate and to impart a functional roughness thereto.

It is known to make the hard chromium coating layer in an electrolytic cell in the presence of chromic acid based on hexavalent chromium (Cr(VI)). Hexavalent chromium is harmful to humans and the environment, and is classified as CMR (Carcinogenic, Mutagenic and harmful to Reproduction).

It is therefore attempted to eliminate the use of hexavalent chromium, which is harmful to health and the environment.

It is known especially from EP2956564 B1 or FR3002239 of the same patent family, a method for manufacturing a piece having a coating layer by HVOF-type spraying onto a substrate. This method comprises a first step of preparing a surface of the substrate to be coated by sandblasting, so as to increase its surface roughness Ra. The method then comprises a step of forming the coating layer by HVOF-type spraying of a powder mixture containing grains of WC-type metal carbide and a Co and Cr binder for this carbide onto the prepared substrate. These carbide grains have dimensions strictly less than 1 μm and in particular less than 450 nm+/−50 nm and the thickness of the coating layer thus formed is less than 50 μm. The method then includes a step of finishing the surface of said coating layer so as to obtain the dimensions and surface finish required in the drawing. These deposits provide a corrosion resistance of approximately 500 h in a salt mist and reduce the risk of the layer formed on the substrate breaking off/detaching.

There is a need to decrease the manufacturing cost of this method and to improve the corrosion resistance, especially for coatings of small thicknesses (<80 μm) of this manufacturing method.

The invention set forth here therefore relates to the improvement of this method for making HVOF deposits.

SUMMARY OF THE INVENTION

The invention provides a solution improving the method described in EP2956564 B1, by adding an impregnation step.

One aspect of the invention relates to a method for manufacturing a piece including a metal substrate at least partially covered with a protective layer, the method comprising steps of:

- preparing a surface to be covered with the substrate; wherein the preparation step is a step of cleaning a substrate to obtain a prepared surface free of dirt or grease, with a roughness Ra of less than 2 μm,
- forming, by spraying a powdery mixture containing submicron metal carbide grains according to a HVOF type spraying method, onto the prepared surface of the substrate, a coating layer, wherein the metal carbide grains each have a dimension strictly less than 1 μm and the maximum thickness of the coating layer thus formed is less than 100 μm,
- characterised in that it further comprises after the forming step:
  - a step of impregnating the coating layer with an organic impregnant together forming an impregnated layer,
  - a step of polishing finishing at least one surface of said impregnated layer so as to form the protective layer comprising a polished surface having a roughness Ra of less than 0.2 μm.

By virtue of the invention, the impregnation step with an organic impregnant makes it possible to decrease the thickness of the coating layer compared with a coating layer described in prior art while improving the level of corrosion resistance. Indeed, the organic impregnant will enter the pores of the coating layer, fill them and thus form a more compact protective layer with the coating layer than a coating layer without impregnation. The organic impregnant can fully enter the coating layer up to the surface of the substrate, thus forming the compact protective layer enabling a prepared substrate surface to be attached, which can only be cleaned by degreasing (unlike the solution described in document FR3002239). It is therefore possible to decrease the necessary thickness of the coating layer as in document FR3002239 while having better corrosion protection, especially for protective layers of small thicknesses (≤80 μm).

Furthermore, in prior art described in document EP2956564 B1, it was necessary to prepare the surface of the substrate by sandblasting to increase the roughness of the surface and thus increase the attachment surface of the coating layer. Here, by virtue of the invention, as the protective layer is more compact, the level of mechanical attachment of the protective layer to the substrate to be coated can be reduced without increasing the risk of delamination. The invention thus enables such a substrate to be only degreased and not sandblasted.

The metal carbide grains are submicron carbides since they each have a dimension strictly smaller than 1 μm.

Furthermore, polishing after and not before impregnation allows the impregnant to penetrate the deposit via its porosity network. Penetration is therefore all the better if the deposit is as-sprayed and therefore "full" of porosity at the surface. Impregnation after polishing would be much less effective.

Further to the characteristics just discussed in the preceding paragraph, the method according to one aspect of the invention may have one or more additional characteristics from among the following, considered individually or according to all technically possible combinations:

According to one embodiment, the organic impregnant is based on a dimethacrylate ester comprising a fluidity for entering the pores of the coating layer having a diameter of between 0.03 μm and 0.3 μm. Such an organic impregnant provides a fluidity making it possible to penetrate the pores of the coating layer. The microporosities in the coating layer are thus filled by virtue of the low viscosity of the dimethacrylate ester, which can fill pores having a diameter of between 0.03 μm and 0.3 μm.

According to one embodiment, the organic impregnant can be based on a dimethacrylate ester or an epoxy or even based on an alcohol comprising a fluidity for entering the pores of the coating layer having a diameter of between 0.03 μm and 0.3 μm.

According to one embodiment, the preparation step is a step of cleaning a substrate to obtain a prepared surface free of dirt or grease, with a roughness Ra of less than 2 μm. Indeed, the preparation step can only be cleaning, especially degreasing, which simplifies and decreases the cost and time of such a method. The step of impregnating the coating layer with an organic impregnant makes it possible to carry out the forming step by spraying the powdery mixture containing metal carbide grains onto a substrate having a roughness Ra of less than 2 μm when it is cleaned, unlike prior art of FR3002239 involving a step of sandblasting the substrate. The preparation step can therefore only be a degreasing step.

According to an example of the preceding embodiment, the preparation step is only a degreasing step to obtain a degreased prepared surface.

According to one embodiment, the metal carbide grains each have a dimension strictly less than 1 μm (submicron carbides) and the maximum thickness of the coating layer thus formed is less than 100 μm, for example between 70 and 90 μm. The powder of submicron carbide grain allows a reduction in the risk of breakage/detachment of the protective layer formed on the substrate while having an improved level of protection against corrosion compared to that of patent EP2956564 B1 due to the impregnant. Furthermore, this allows a reduction in the spraying time required to make the coating layer and thus a reduction in the mass of the coating layer thus formed.

Furthermore, decreasing the thickness of the coating layer improves resistance to delamination under stress (also known as "spalling") and decreases the forces transmitted by the coating-substrate interface.

According to one embodiment, the step of impregnating the coating is carried out using a brush by dipping the brush into a container of organic impregnant and applying it to the surface of the coating layer.

According to one embodiment, the step of impregnating the coating comprises a sub-step of polymerising the impregnant on the coating layer before the finishing step.

Another aspect of the invention relates to a piece obtained by the method according to the invention, with or without the different possible combinations of the characteristics previously described.

Another aspect of the invention relates to a piece comprising a metal substrate and a protective layer at least partially covering the substrate, made of submicron metal carbide, impregnated with an organic impregnant and comprising a polished surface having a roughness of less than 0.1 μm or 0.2 μm. The surface is polished to a roughness of less than 0.1 μm or 0.2 μm depending on the uses of the piece.

Such a piece has a lower production cost than a piece according to the method described in EP2956564 B1 while having at least the same level of corrosion resistance.

According to one embodiment, the polished surface is to be subjected to fretting and/or revolving. (By revolving, it is meant the forces subjected to a cylindrical part of an axis, generally its end, pivoting in or on a piece holding it (clevis, bush, flange, bearing)).

According to one exemplary embodiment, the piece is a hinge axis or an axle in the aeronautical field.

According to one embodiment, the polished surface is to be subjected to static and/or dynamic sealing zones. For example, the piece is a sliding rod.

The invention and its different applications will be better understood upon reading the following description and upon examining the accompanying figures.

BRIEF DESCRIPTION OF THE FIGURES

The figures are set forth by way of indicating and in no way limiting purposes of the invention.

FIG. 1*a* represents a schematic representation of a cross-section of a piece comprising a coating layer on a substrate.

FIG. 1*b* represents a schematic representation of a cross-section of a piece comprising an impregnated layer on the substrate.

FIG. 1*c* represents a schematic representation of a cross-section of a piece comprising a protective layer on the substrate.

FIG. 2 shows a schematic representation of the manufacturing method.

FIG. 3 schematically shows a sample having been subjected to a corrosion test in a salt atmosphere comprising a polished surface according to the invention and a polished protective surface according to prior art.

DETAILED DESCRIPTION

The figures are set forth by way of indicating and in no way limiting purposes of the invention.

As indicated previously, the manufacturing method according to the invention is preferably used to produce a piece 1, an enlarged cross-section of which is schematically represented in FIG. 1*c*.

In particular, the piece 1 is used in the aeronautical field.

The piece 1 in cross-section represented in FIG. 1*c* comprises a metal substrate Sub partially represented and a protective layer Pro comprising a polished surface S3.

FIG. 2 represents a flow chart of a method for manufacturing the piece 1.

The piece 1 is generally made by machining to have at least one portion of a cylindrical surface in the case of a rod, which may be a hinge axis, an axle or even a sliding rod of a landing gear. This cylindrical portion is hereinafter called as the substrate Sub. The protective layer Pro is therefore annular and is here to function in static and/or dynamic sealing zones. For example, the protective layer Pro is to be subjected to joint friction to allow the rod to slide relative to a shaft of the landing gear or is to be subjected to fretting and/or revolving (meaning the forces subjected to a cylindrical part of an axis, generally its end, pivoting in or on a piece holding it (clevis, bush, flange, bearing)), for example for a hinge axis or an axle.

The protective layer Pro has to provide both protection against corrosion of the piece, sealing between the surface of the protective layer and another piece, for example the shank, to limit the risk of hydraulic fluid leaks, wear resistance under pressure, and "spalling" resistance, also known as spalling tests, with alternating tensile and compressive movements with a load ratio of R=−1.

It should be noted that the substrate Sub is a metal alloy of the steel or titanium type.

As seen in FIG. 2, the method for manufacturing the piece 1 comprises a step of preparing A a surface S1 to be covered, of the substrate Sub, in order to obtain a prepared surface S1. Here, in this example, the preparation step is a degreasing step and therefore does not require sandblasting or sanding. Of course, according to another example and for reasons other than cost decrease, the roughness can also be modified during the step of preparing a substrate, for example by sandblasting.

Here, in this example, the step of preparing the substrate is only a cleaning, degreasing of the substrate having at its cleaned surface S1 for example a roughness Ra of less than 2 μm for example 1.9 μm. The roughness of a surface can for example be measured according to the ISA3274-1997, ISO 4287-1997, ISO 4288-1996, ISO 11562 standards.

The method for manufacturing the piece 1 comprises, after the preparation step A, a step of forming B a coating layer Rev on the surface S1, here degreased, of the substrate Sub, by HVOF-type spraying of a powdery mixture containing submicron metal carbide grains. FIG. 1*a* represents a cross-section of the piece 1 comprising the substrate Sub and the coating layer Rev deposited onto the surface S1.

In particular, in this example the grains have dimensions of strictly less than 1 μm and the thickness Epmax of the coating layer Rev thus formed is in this example less than 90 μm, for example between 70 and 90 μm. This powdery mixture contains metal carbide grains embedded in a binder, in this case WC tungsten carbide embedded in cobalt Co and chromium Cr. Cobalt Co serves as a binder and chromium Cr serves as protection against oxidation.

In this example, this powdery mixture is in the form of agglomerates/aggregates with a particle size of less than 50 μm and preferably less than 30 μm to form a maximum coating layer of less than 90 μm and more than 70 μm. The agglomerates are generally made by sintering to create bridges between the carbide and the binder material. This sintering is generally carried out with a furnace to melt the binder without decarburising the metal carbide grains.

Ideally, the WC metal carbide grains present in this powdery mixture are calibrated to have a size of strictly less than 1 μm, and preferably in the order of 400 to 800 nm in mean particle size.

It should be noted that the present invention can be implemented with other types of chemical compositions containing at least one metal carbide and at least one binder. Among examples of possible compositions, there can be WCCo, which may be in the form of a mixture of 83% WC and 17% Co or in the form of a mixture of 88% WC and 12% Co, or WCCoCr.

As the coating layer Rev is thin, and the powder agglomerates/aggregates have a small particle size, the resulting roughness at the surface S2 of the coating layer Rev in this example is in the order of 3 μm immediately after spraying.

The method for manufacturing the piece 1 comprises, after the forming step B, a step of impregnating C the coating layer Rev with an organic impregnant Io, together forming an impregnated layer Imp.

FIG. 1*b* represents the piece 1 in cross-section with the impregnated layer Imp comprising the coating layer Rev impregnated with the organic impregnant Io.

The organic impregnant Io may be based on dimethacrylate ester, epoxy, alcohol, etc. and must have sufficient fluidity for entering the pores of the coating layer Rev. Indeed, the impregnant has to be able to penetrate the coating layer via the network of open porosities which in this example represents 10% of the porosity of the coating layer with a median pore diameter in the order of 0.20 μm.

The impregnation step can therefore be carried out by brushing the surface S2 of the coating layer Rev with the organic impregnant Io, for example with a brush.

The impregnation step C comprises a sub-step of waiting for polymerisation of the impregnant forming the impregnated layer Imp comprising an impregnated surface S2'.

As previously specified, the coating layer Rev has a roughness Ra of the surface S2, here Ra of S2=3 μm in the same order of magnitude as the roughness Ra of the surface S1, here in this example 2 μm. In addition, the impregnated layer Imp of organic impregnant is the same as the coating layer Rev, which does not generate any additional roughness, hence Ra of the impregnated surface S2' of the impregnated layer Imp is identical to Ra of S2. Indeed, the pores of the coating layer Rev are filled by the organic impregnant which has a low viscosity to penetrate all pore sizes, even the smallest (from 0.03 μm to 0.3 μm) and therefore does not remain on the surface S2 of the coating layer Rev.

The method further comprises a step of polishing finishing D the surface S2' of said impregnated layer Imp so as to ensure that the roughness Ra of the polished surface S3 of the protective layer Pro is less than 0.1 μm or less than 0.2 μm depending on the applications. Polishing can, for example, be carried out using a diamond band.

The step of polishing the impregnated layer Imp reduces the thickness of this layer until the protective layer Pro with its polished surface S3 is obtained. Here, the step of polishing the impregnated layer Imp reduces the thickness of this layer by about 20 μm. The impregnated layer Imp having in this example a thickness of less than 90 μm, for example between 70 and 90 μm, the protective layer Pro therefore comprises a thickness, measured between the polished surface S3 and the surface S1, of between a minimum thickness Epmin of 50 μm and a maximum thickness Epmax of 70 μm.

Indeed, simple polishing of the protective surface S2' makes it possible to obtain a roughness Ra of less than 0.1 μm or less than 0.2 μm, thus enabling the polished surface S3 to be subjected to static and/or dynamic sealing zones.

It should be noted that traditionally, a step of grinding the coating layer is required to obtain a given layer geometry and layer surface condition. But, grinding an annular layer formed on a straight cylindrical portion makes it necessary to provide a significant layer thickness to ensure that, after grinding, a minimum layer thickness is maintained on the substrate.

By eliminating the step of grinding the annular layer, the method according to the invention makes it possible to obtain the desired layer thickness directly without having to grind the piece, thus eliminating the risk of grinding defects appearing (grinding a cylindrical annular layer often leads, due to uncertainties in positioning the piece on the grinding machine, to the appearance of too thin layer zones that are difficult to detect and likely to promote premature corrosion of the substrate). The invention eliminates this risk of having a locally too thin layer that cannot be detected.

FIG. 3 schematically represents a test piece 2 comprising, on the left, a polished surface S3 of the protective layer Pro formed like the piece 1 according to the method of the invention, and, on the right, a surface of the coating layer S2, that is, without the impregnation step C.

The test piece 2 has been tested for corrosion resistance, the test being carried out in a salt atmosphere (salt mist) according to ASTM B117.

The test piece 2' corresponds to the test piece 2 after 1,000 h in a salt atmosphere.

It can thus be seen that the surface S3 of the impregnated part of the test piece 2 does not have any trace of pitting (left part) even after 1,000 h of exposure to salt mist. Whereas the surface S2 of the unimpregnated part (right-hand side) is attacked: firstly, with traces of pitting 9 and then with widespread development of corrosion 90.

Furthermore, a wear resistance test has been carried out on a piece 1 obtained with the method of the invention having a cylindrical zone with a diameter of 10 mm comprising the surface S3 and onto which a bronze ring (AMS4590) is mounted, in the presence of grease. The wear test comprises a first phase of 500 cycles of pressure of the ring on the surface S3 at 50 MPa, then a second phase of 500 cycles at 100 MPa and a final phase with 4,000 cycles at 200 MPa, and a frequency of 0.1 Hz. The coefficient of friction and the wear rate (measurement of the external diameter of the axis and the internal diameter of the ring) have been recorded every 500 cycles, and the grease has been changed each time. The test showed that the piece 1 obtained with the method of the invention comprises a similar level of wear resistance performance to that achieved according to the method in EP2956564 B1.

The manufacturing method of the invention thus makes it possible to obtain a less expensive piece than according to the method of EP2956564 B1 while including a metal substrate Sub at least partially covered with a protective layer Pro having similar wear resistance.

Furthermore, surprisingly, starting from a substrate that has only been cleaned without modifying its roughness in the preparation step, unlike the substrate that has been subjected to a sandblasting or sanding step in the preparation step in EP2956564 B1, it is noticed that, in the invention, the protective layer resists at least equally to wear and corrosion as would the coating layer in this EP2956564 B1, that is, without impregnation.

Furthermore, a spalling test, also called spalling resistance test, that is, no loss of adhesion between the deposit of the protective layer Pro and the substrate Sub of a test piece, has been carried out, with alternating tensile and compressive movements with a load ratio R=−1, on samples with a protective layer Pro with a thickness of 80 μm in the finished state. The test showed that a piece including a metal substrate Sub at least partially covered with a protective layer Pro obtained according to the manufacturing method of the invention includes a spalling resistance under 1140 MPa, 1250 MPa and 1300 MPa for a thickness of 80 μm.

Finally, on the same principle as the spalling test, fatigue tests have been carried out on a piece 1 obtained with the method of the invention. These tests consisted of alternating tensile and compressive movements under a load ratio R=0.1. The results obtained showed that the allowance defined in the past for this type of deposit/testing is still respected in the aeronautical field.

By virtue of all these characteristics, the method of the invention makes it possible to obtain a finished piece that is lighter, less expensive and with at least the same level of performance, while retaining the characteristics necessary for a proper sealing between the piece 1 and another piece.

It should be noted that the carbide grains used may be of a type of metal carbide other than tungsten carbide and the binding materials may be of materials other than chromium and cobalt.

Unless otherwise specified, the same element appearing in different figures has a single reference.

The invention claimed is:

1. A method for manufacturing a piece including a metal substrate at least partially covered with a protective layer, the method comprising:

preparing a surface to be covered with the substrate, wherein the preparing is only a degreasing step to obtain a first degreased prepared surface, with a roughness Ra of less than 2 μm, forming, by spraying a powdery mixture containing submicron metal carbide grains according to a HVOF type spraying method, on the first degreased prepared surface of the substrate, a coating layer, wherein the metal carbide grains each have a dimension strictly less than 1 μm and a maximum thickness of the coating layer thus formed is less than 100 μm, wherein, at an end of said forming by spraying the powdery mixture containing submicron metal carbide grains according to the HVOF type spraying method, said coating layer has a second surface, and after the forming:

impregnating the coating layer with an organic impregnant by applying the organic impregnant to the second surface, the coating layer impregnated with the organic impregnant together forming an impregnated layer, finishing by polishing at least one surface of said impregnated layer, so as to form the protective layer comprising a polished surface having a roughness Ra of less than 0.2 μm.

2. The method according to claim 1, wherein the organic impregnant is based on a dimethacrylate ester, or an epoxy or an alcohol comprising a fluidity for entering the pores of the coating layer having a diameter of between 0.03 μm and 0.3 μm.

3. The method according to claim 1 wherein the impregnating of the coating is carried out with a brush by dipping the brush into a container of organic impregnant and applying it to the second surface of the coating layer.

4. The method according to claim 1, wherein the impregnating of the coating comprises a sub-step of polymerising the impregnant on the coating layer before the finishing.

5. A piece comprising a metal substrate and a protective layer at least partially covering the substrate, made of submicron metal carbide impregnated with an organic impregnant and comprising a polished surface having a roughness of less than 0.2 μm, wherein the piece is manufactured by the method according to claim 1.

6. The piece according to claim 5, wherein the polished surface is to be subjected to fretting and/or a force subjected to a cylindrical part of an axis, pivoting in or on a piece holding it.

7. The piece according to claim 6, wherein the piece is a hinge axis or an axle in the aeronautical field.

8. The piece according to claim 5, wherein the polished surface is to be subjected to static and/or dynamic sealing zones.

9. The piece according to claim 5, wherein the polished surface has a roughness of less than 0.1 μm.

10. The method according to claim 1, wherein the second surface of the coating layer has a surface roughness Ra that is at least equal to, or up to 100% greater than, the first degreased prepared surface.

* * * * *